US006588377B1

(12) United States Patent
Leary et al.

(10) Patent No.: US 6,588,377 B1
(45) Date of Patent: Jul. 8, 2003

(54) PROCESS AND APPARATUS FOR RECYCLING WATER IN A HOT WATER SUPPLY SYSTEM

(76) Inventors: Kevin J. Leary, 209 Bay Rd., Hamilton, MA (US) 01982; Douglas F. Fuller, 22 Cleveland Ave., Woburn, MA (US) 01801

( * ) Notice: Subject to any disclaimer, the term of this patent is extended or adjusted under 35 U.S.C. 154(b) by 0 days.

(21) Appl. No.: 10/198,782

(22) Filed: Jul. 22, 2002

(51) Int. Cl.[7] ..... F24M 9/00

(52) U.S. Cl. ..... 122/19.1; 122/13.01; 122/451.2; 122/452; 122/13.3; 220/723; 138/30; 126/362.1

(58) Field of Search ..... 122/13.01, 13.3, 122/19.1, 451 R, 451.1, 451.2, 452; 126/362.1, 344; 220/723; 137/565.34, 593; 138/30

(56) References Cited

U.S. PATENT DOCUMENTS 2,695,753 A * 11/1954 Kirk, Jr. ..... 237/8 R
4,240,405 A * 12/1980 French ..... 126/637
4,341,202 A * 7/1982 French ..... 126/584
5,584,316 A * 12/1996 Lund ..... 137/337

FOREIGN PATENT DOCUMENTS

WO WO 89/11344 * 11/1989

* cited by examiner

*Primary Examiner*—Jiping Lu
(74) *Attorney, Agent, or Firm*—Paul J. Cook

(57) ABSTRACT

A process and apparatus are provided for conserving water and heat energy in a hot water supply system. A holding tank is provided near the Point Of Use to capture unwanted cooled water. An integrated displacement actuator allows this volume to be recirculated back into the hot water supply line after use. The actuator consists of a flexible bladder or rolling diaphragm that divides the holding tank into two compartments; one for non-compressible supply water, and the second for a compressible phase change fluid. At ambient temperature, the phase change fluid condenses to a liquid phase at a relatively low pressure, allowing diverted water to flow into the tank from the hot water supply system. When the phase change fluid is warmed by the adjacent hot water, it changes to a gaseous phase, pressurizing the holding tank and allowing re-injection of the cool water into the hot water supply system. A control system is provided direct water flow based on time, temperature and pressure.

9 Claims, 3 Drawing Sheets

PROCESS AND APPARATUS FOR RECYCLING WATER IN A HOT WATER SUPPLY SYSTEM

BACKGROUND OF THE INVENTION

This invention relates to a process and apparatus for conserving water in a hot water supply system. More particularly, this invention relates to a process and apparatus for storing and subsequently recycling relatively cool water in the system which is located between a hot water heater and a point of use of hot water.

In typical hot water delivery systems having a water heater and a distal point of use (POU); intermediary piping between the heater and the POU most often contains relatively cool water which becomes cool due to heat energy exchange from the water to the atmosphere and structure surrounding the intermediary piping. As a result, it is common practice to open an outlet such as a faucet to move the cool water into an open sink until the hot water has reached the outlet. The amount of water wasted in this manner can be as high as three gallons or more per use of the hot water system. This problem is most pronounced in slab built homes, particularly in the South or Southwest United States that require long horizontal runs of piping between the water heater and the POU. The need for capturing the volume of cool water between the water heater and the POU has long been known. However, energy-efficient systems have not been available.

Systems that offer instant hot water at the POU are well known in larger buildings such as hotels and hospitals. Dedicated return lines allow the main hot water supply to be configured in continuous loops, requiring only short runs of piping between the heated trunk lines and the Points of Use. Similar systems are occasionally installed in domestic structures, but are expensive to build and operate.

There are a number of presently available systems that use existing, conventional plumbing to effect instant hot water (Imhoff, U.S. Pat. No. 5,009,572, Laing, U.S. Pat. No. 5,941,275). These operate by constantly pumping hot water to the point of use using the cold water supply as a return line. However, these systems require a number of compromises, including the following:

1. Because the hot water supply plumbing is kept hot at all times (as is, to a lesser degree, the cold water plumbing), a large amount of heat is lost from the pipes to the surrounding structure. Exacerbating this situation is that in warm weather locations, this waste heat must then be taken back out of the structure via air conditioning. A typical case study estimated that a constant re-circulation system saved $40 per year in water, but required an additional $200 of annual water heating energy and $300 of air conditioning.

2. Using the cold water supply as a return line results in an unstable supply temperature at the POU. Between uses, the hot water supply is rarely fully hot, and the cold water supply line will often be filled with lukewarm water. As a result, the mixing valve will require constant adjusting to maintain the desired outlet temperature until the cold water supply becomes completely cold and the hot water supply becomes completely hot.

3. Existing systems require AC electrical power to run pumps constantly. This requirement dramatically increases the cost of installation, and results in pumping costs that are comparable in cost to the expected water savings.

A number of systems have been disclosed that attempt to minimize the heat energy that is lost from hot supply plumbing. These systems transfer water from the cold supply to the hot supply before use, and transfer cold water back into the hot water supply after use. This forces the heated water back into the heater tank where it can be stored efficiently (Britt, U.S. Pat. No. 5,105,846, Lund, U.S. Pat. No. 5,277,219). However, such systems typically require large pumps to overcome dynamic head loss as water is moved through long runs of cold and hot water plumbing. Response time is typically slow, and installation and pumping costs can be expensive.

Holding tanks that are local to the POU and used to capture unwanted cooled water have also been proposed. A typical problem with POU holding tanks is that to get acceptable response time, the diverted water must be allowed to drop to near atmospheric pressure. Considerable pumping is then required to repressurize the water to the city supply pressure before it can be re-injected into the water heater inlet. Storch discloses a diverter valve and holding tank in U.S. Pat. No. 5,564,462. That system relies on conventional mechanical pumping to return the captured water to the water heater. In addition, it requires a dedicated return line to the water heater, rather than using the hot water supply line itself. In so doing, it loses the energy benefit of cooling the pipes after use.

In general, phase-change actuators are also well known. The earliest steam-powered machines utilized water as a working fluid in an open loop system. More recent designs such as the Solar Water Pump disclosed by O'Hare in U.S. Pat. No. 4,309,148 use a water vapor in a closed loop design with a diaphragm divider.

Actuators that utilize refrigerants and propellants are also well known. These fluids are often advantageous because they change phases at more convenient temperatures and pressures than does water. In U.S. Pat. No. 4,955,921 Basile discloses a toilet flushing mechanism that uses a propellant-filled bladder in a containment vessel for water. Rather than letting the tank water drop to atmospheric pressure upon refill, that system maintains the water at an elevated pressure using a pressurized bladder, thereby reducing the amount of water required per flush. Using a propellant in the bladder rather than air, the toilet tank volume is minimized. When water flows into the tank, the propellant in the bladder liquifies, allowing the bladder to shrink to a very small volume. During flushing, the fluid in the bladder expands back into its gaseous phase, maintaining the elevated pressure inside the reservoir and helping drive out the water for flushing. In this concept, no effort is made to vary bladder pressure by varying the temperature of the contained vapor.

In U.S. Pat. No. 4,070,859, Sobecks discloses a linear actuator that does vary the propellant temperature using a heating element. A rolling diaphragm is used to contain the propellant and transfer the resulting force to a spring-loaded shaft. Although such actuators can be inefficient and expensive, they allow accurate modulation of force, and were thus investigated by Chrysler for use in braking systems (Miesterfeld, U.S. Pat. No. 5,666,810).

It would be desirable to provide a process and apparatus for conserving cooled water in a hot water delivery system that includes a water heater and a control means, such as a faucet for delivering hot water to a point of use. In addition, it would be desirable to provide such a process and apparatus which minimizes heat loss from hot water supply plumbing. In addition, it would be desirable to provide such a process and apparatus which avoids the need for mechanical pumping means to pump water against a back pressure from a water source to the system, or overcome significant dynamic head loss due from moving water through long runs of piping. In addition, it would be desirable to provide such a process and apparatus which minimizes the time it takes hot water to be presented at the faucet.

SUMMARY OF THE INVENTION

The present invention provides a process and apparatus for conserving cool water located between a water heater and a point of use in a hot water delivery system. In addition, the system conserves heat energy by routing the unused hot water that is contained in the supply plumbing back to the water heater between uses. The system uses a holding tank at the Point of Use (POU) to capture and hold the otherwise-unused volume of cold water. Unique to this system is the dual-phase actuator that allows re-injection of the cooled water into the supply plumbing.

In accordance with this invention, the POU holding tank incorporates a flexible bladder or rolling diaphragm that separates the tank into a variable volume that can contain water from the hot water supply line, and another variable volume that contains a fixed amount of propellant or refrigerant in liquid and wet vapor phases.

At room temperature, the holding tank is at a low pressure relative to the supply plumbing, and provides a ready receptacle into which unwanted cooled water can be diverted by a control means. Said controller then utilizes a temperature sensor to determine when the hot water supply temperature has reached a predetermined setpoint, at which time the diverter valve is actuated to allow flow through to the POU. The process of introducing hot water to the POU also routes hot water through a heat-exchanging sump containing liquid propellant. Once the propellant is warmed by the adjacent hot water, the holding tank is repressurized to a pressure above that of the supply plumbing. At a predetermined later time, the diverter valve can be reopened, affecting a re-injection and "replacement" of the cool water slug back into the hot water supply line. The hot water is thus displaced back into the water heater, minimizing the heat loss from the hot water plumbing.

Note that most municipalities require backflow preventers (check valves) inline as the supply piping enters a structure. As a result, re-injecting a volume of water from a POU holding tank requires a buffer tank elsewhere in the system to accommodate the increase in total system volume. Such a tank can be easily added near the water heater inlet. The displaced hot water can be a) reinjected to the water heater outlet, forcing water out of the inlet and into the buffer tank, or b) reintroduced to the water heater inlet via the buffer tank. The insulated buffer tank would store the heated water efficiently, and at high pressure until the next requirement for hot water. This type of accumulator tank is well known in the hydraulic actuator design art.

The process and apparatus of this invention utilizes a phase change fluid. By "phase change fluid" as used herein is meant a composition that can be either in the liquid phase or in the gas phase at useful temperatures and pressures. In the present invention, it is preferred to utilize a fluid that is a liquid near room temperature and at atmospheric pressure. This minimizes the holding tank pressure during cold water capture, which minimizes tank-filling time, and improves system response time. Additionally, it is preferred that the vapor pressure of the fluid rise to 65 psig or more at 125° F. or less. This is the pressure at which the cold water slug can be re-injected into the hot water supply line. Also, 125° F. is a generally accepted safe temperature at which to maintain the hot water supply in households with children.

Compounds that exhibit these properties include Butane, as well as many safe propellants such as hexafluoropropane. These fluids are used for industrial and medical applications such as fire extinguishers and aerosol-delivered medications.

The process and apparatus of this invention will also result in a significant reduction in the time it takes hot water to be presented at the faucet. This is because the system can be located inline at a position before the primary restrictions in the supply line, which include the under-sink shutoff valve and the POU mixing valve. The system described here is retrofittable to all conventional plumbing configurations.

DESCRIPTION OF SPECIFIC EMBODIMENTS

Figure 1:
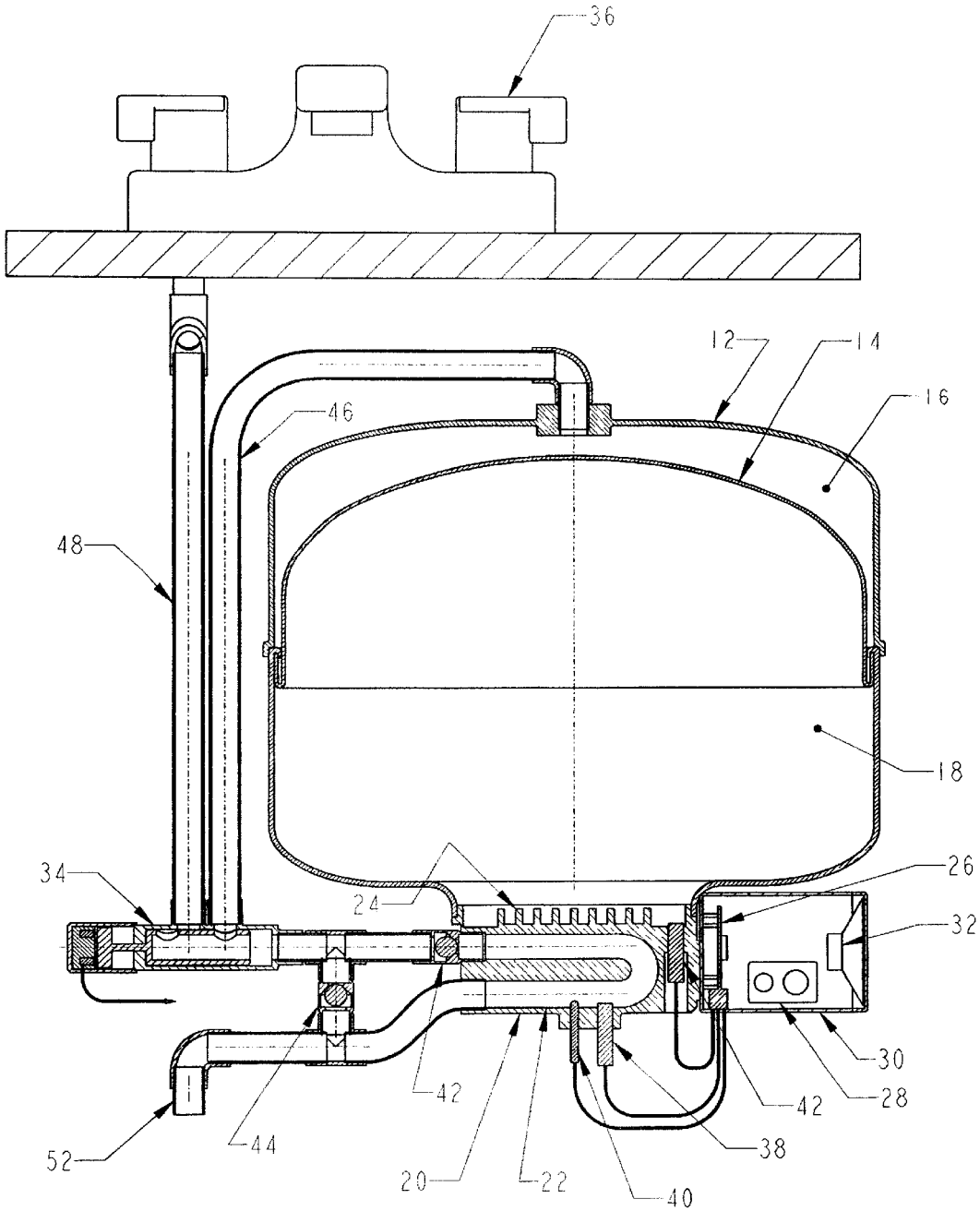
FIG. 1 is a schematic view of the holding tank assembly, including a dual-phase actuator and control system.
Figure 3:
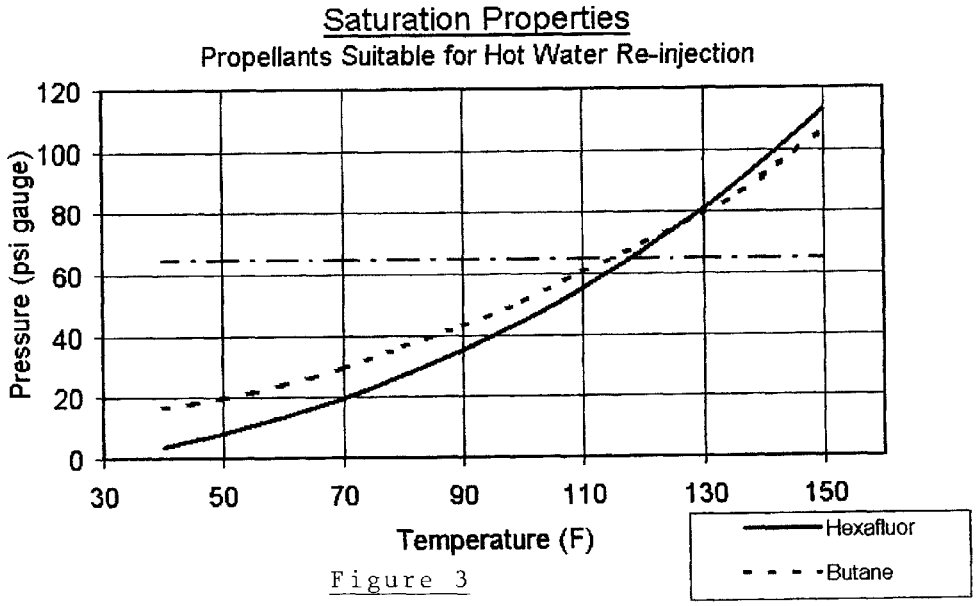
FIG. 3 is a graph representative of pressure as a function of temperature for a phase change fluid.

Referring to FIG. 1, a holding tank 12 located in proximity to the POU includes a flexible bladder or rolling diaphragm 14 that is secured to the inner walls of the container and separates the tank into two compartments. The first variable-volume compartment 16 can be opened to the hot water supply line, and filled with unwanted cooled water. The second variable-volume compartment 18 is sealed, and filled with a fixed amount of phase-change fluid. Assuming that the actuator bladder is filled with hexafluoropropane, the tank will be maintained at a pressure of roughly 20 psig at room temperature (Refer to FIG. 3 which quantifies pressure vs. temperature for butane and hexafluoropropane). The second compartment 18 includes a heat-exchanging sump 20 that can be used to heat or cool the phase change fluid. Sensible heat is removed from the hot water supply 22 and conducted to a convoluted geometry inside the tank, such as a finned surface 24 that transfers heat to the propellant fluid via conduction and convection. In the preferred implementation, the system is controlled using a single-board processor 26 that takes Supply Temperature, Supply Pressure and Tank Pressure as inputs, and Outputs a control signal to the Diverting Valve 34 and an audible indicator. The necessary components could be packaged in a controller module 30 which includes a battery 28 and a speaker 32. Use of power-efficient components would result in battery life of 6 months or more.

Figure 2A:
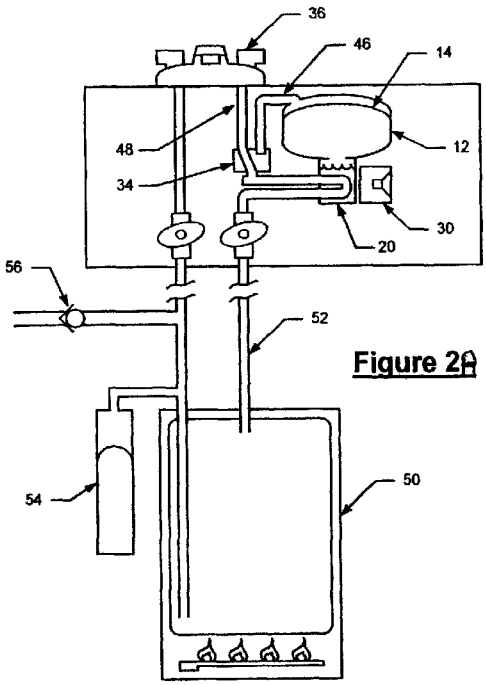
FIG. 2*a* illustrates the system of this invention with no water flow.
Figure 2B:
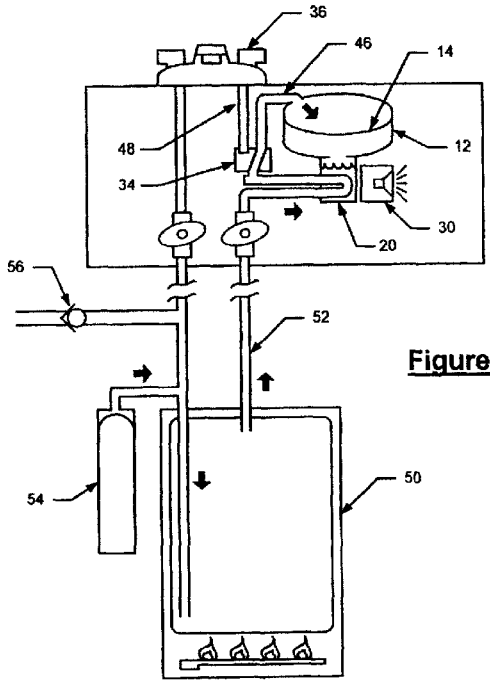
FIG. 2*b* illustrates the system of this invention when cooled water is being captured.
Figure 2C:
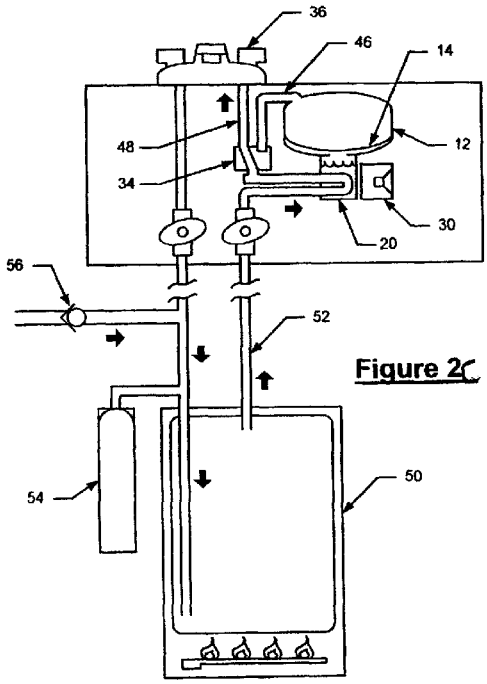
FIG. 2*c* illustrates the system of this invention when hot water is delivered to a point of use.

Refer to FIGS. 2*a*–2*d* for a typical sequence of events associated with the presented process and apparatus. FIG. 2*a* shows the initial "Ready" mode of the apparatus of this invention. The inlet to the holding tank 12 is closed by the 2-position, 3-port diverter valve 34. There is little or no water in holding tank 12, and the entire tank volume is at low pressure. Faucet 36 is opened and pressure sensor 38 (FIG. 1) senses the decreased pressure in conduit 22 which is communicated to controller 30 to affect actuation of the diverter valve 34 to route water flow to the holding tank 12 via conduit 46. Note that the valve position in FIG. 1 reflects this "capture" mode. As shown in FIG. 2*b*, the cool water volume in conduit 52 between the POU and the water heater 50 is directed into container 12. As water enters the first compartment 16, the propellant in compartment 18 will be reduced in volume, condensing most of the propellant vapor back into a liquid phase. FIG. 2*b* notes an optional audible signal that may be generated by the controller 30 to indicate to the user that they system is diverting water.

Controller 30 utilizes a temperature sensor 40 to determine when the hot water supply temperature has reached a predetermined setpoint, at which time the diverter valve 34 is actuated to allow flow to the faucet 36 via conduit 48 (FIG. 3*c*). While hot water is being used at the faucet 36, the propellant is being warmed via the heat-exchanging sump 20. The propellant vaporizes as it warms, repressurizing the holding tank 12. Once the tank pressure rises above the water supply pressure, as measured by pressure transducers 42 and 38 (FIG. 1), the tanks stands ready to re-inject the cold water volume back into the hot water supply plumbing. Typically, water from central water municipal supplies is delivered at or near 60 psig, depending on the altitude of the particular user. In this case, the hexafluoropropane propellant would have to be heated to a mean temperature of at least 114° F. to commence re-injection.

Figure 2D:
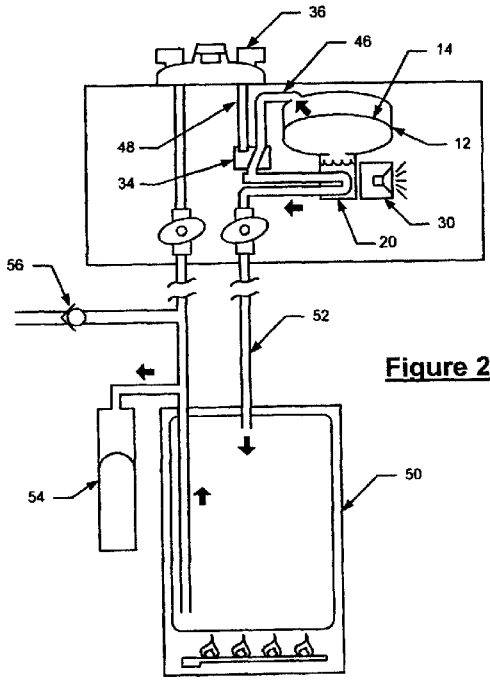
FIG. 2*d* illustrates the system of this invention when cooled water is re-injected into the hot water supply line, displacing hot water into the hot water heater and buffer tank.

Once a preset time has elapsed after completion of the hot water usage, the diverter valve 34 is actuated to open the holding tank 12, affecting a re-injection of the cool water slug back into the hot water supply line; conduits 46 and 52 (FIG. 2*d*). Once the holding tank pressure 42 and the supply pressure 38 equalize, the diverter valve 34 is actuated to close the tank inlet, leaving the tank empty. The propellant in volume 18 is then allowed to cool, leaving the holding tank 12 in an empty, low-pressure state. This returns the systems to "Ready" mode, completing an operating cycle.

FIG. 1 shows two check valves, 42 and 44, that can be positioned to route hot water through the sump 20 via conduit 22 on the way to the faucet 36. However, during reinjection, the valves route cool water from conduit 46 to conduit 52, avoiding sump 20 and conduit 22. In this way, the water that is in contact with the sump remains warm, avoiding recondensing the propellant before holding tank 12 is completely empty. Under the force of the expanded bladder 14, the cool water in container 12 is directed back into the hot water supply line 52, displacing heated water back into the heater tank 50. In turn, water is displaced from the water heater tank 50 via the tank inlet to a buffer tank 54 which is in fluid communication with the water heater. This buffer tank is made necessary by the check valve 56 in the main building water supply line.

Figure 4:
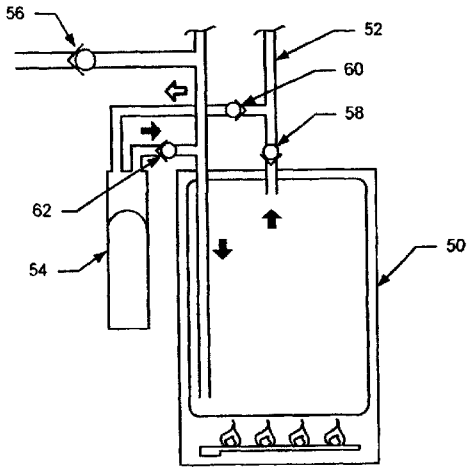
FIG. 4 illustrates an alternative embodiment of this invention wherein returning hot water is routed to the water heater via a buffer tank.

FIG. 4 depicts an alternative configuration wherein hot water is routed back to the heater tank 50 via the buffer tank 54. There, the hot water is stored at an elevated temperature and pressure until the next call for hot water. When hot water is next required at a POU, the stored hot water will be expelled from the buffer tank 54 into the water heater 50 inlet. Check valves 58, 60 and 62 in the supply lines affect the water flow shown by the flow arrows. A configuration such as this may be advantageous for controlling supply temperature when there are multiple Points of Use. In either configuration, water heater 50 can be any conventional water heater such as a commercially available gas heater or an electric heater.

Figure 5:
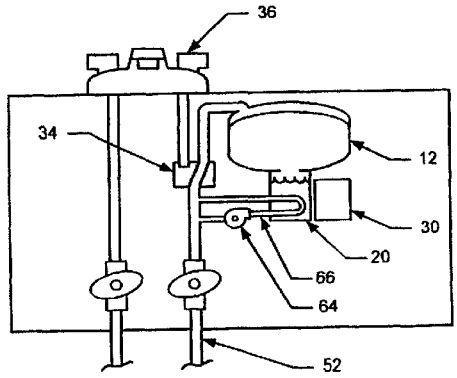
FIG. 5 illustrates an alternative embodiment of this invention wherein hot water is delivered to the heat-exchanging propellant sump via dedicated tubing, a circulating pump, and a control means.

An alternative propellant heating means is shown in FIG. 5. While the process and apparatus of this invention has been described with reference to FIGS. 1 and 2*a*–2*d* utilizing "passive" introduction of heating water to the propellant sump 20, it may often be advantageous to actively introduce hot water to the sump using a small recirculating pump 64 and dedicated tubing 64. When re-injection is desired, the circulator pump 64 would be activated by control system 30 to route heated water from supply conduit 52 to the heat exchanging sump 20. Because there is no head differential in this process, the pumping power required to effect this circulation is very low. Additionally, a simplified control system can be implemented without a microprocessor. Inputs and outputs can be routed through a Printed Circuit Board (PCB) containing an analog logic device; e.g., Programmable Array Logic. Temperature and pressure transducers can also be replaced by preset switches.

What is claimed is:

1. A process for recovering and subsequently reintroducing cool water in a hot water delivery system which comprises: supplying a container separated by a flexible bladder in the container to form a first compartment configured to store water and a second compartment configured to store a phase change fluid, providing control means to affect water flow to and from said first compartment and to heat said phase change fluid using adjacent domestic hot water to affect a pressure change inside said first and second compartments, and allowing actuation of a return flow of cool water into said hot water delivery system.

2. The process of claim 1 wherein cool water is displaced from said first compartment, returning said hot water to water heater outlet, and positioning a second accumulator container to capture water displaced from a water heater inlet.

3. The process of claim 1 wherein cool water is displaced from said first compartment, returning said hot water to water heater inlet via a second accumulator container.

4. The process of any one of claims 1, 2, or 3 wherein said domestic hot water is routed into heat exchange relationship with said phase change fluid, and out of heat exchange relationship with phase change fluid.

5. The process of any one of claims 1, 2, or 3 wherein said phase change fluid is heated by pumping hot water contained in said hot water delivery system into heat exchange relationship with said phase change fluid.

6. In a hot water delivery system including a water heater, an outlet for the water heater and a first conduit for effecting fluid communication between the water heater and the outlet, the improvement comprising: a container separated by a flexible bladder in the container to form a first compartment configured to store water and a second compartment configured to store a phase change fluid, and a control means to affect water flow to and from said first compartment, heating said phase change fluid using adjacent domestic hot water to affect a pressure change inside first and second compartments, and actuating of a return flow of cool water into said hot water delivery system.

7. The apparatus of claim 6 which includes a second container in fluid communication with said hot water heater.

8. The apparatus of any one of claims 6 or 7 including means for routing domestic hot water into heat exchange relationship with said phase change fluid or out of heat exchange relationship with said phase change fluid.

9. The apparatus of any one of claims 6 or 7 including a pump and control means for directing hot water from said hot water heater into heat exchange relationship with said phase change fluid.

* * * * *